US005963234A

United States Patent [19]

Miyazawa et al.

[11] Patent Number: 5,963,234

[45] Date of Patent: Oct. 5, 1999

[54] LAMINATED INK JET RECORDING HEAD HAVING FLOW PATH UNIT WITH RECESS THAT CONFRONTS BUT DOES NOT COMMUNICATE WITH COMMON INK CHAMBER

[75] Inventors: Yoshio Miyazawa; Minoru Usui; Fujio Akahane; Takahiro Katakura; Motonori Okumura; Tomoaki Abe, all of Nagano, Japan

[73] Assignee: Seiko Epson Corporation, Tokyo, Japan

[21] Appl. No.: 08/700,028

[22] Filed: Aug. 20, 1996

[30] Foreign Application Priority Data

Aug. 23, 1995 [JP] Japan ..... 7-237611
Mar. 28, 1996 [JP] Japan ..... 8-099196

[51] Int. Cl.[6] ..... B41J 2/045

[52] U.S. Cl. ..... 347/70; 347/71; 347/43

[58] Field of Search ..... 347/68–72, 43

[56] References Cited

U.S. PATENT DOCUMENTS 5,402,926 4/1995 Takeuchi et al. ..... 228/174
5,463,412 10/1995 Matsuda ..... 347/43
5,574,486 11/1996 Whitlow et al. ..... 347/45

FOREIGN PATENT DOCUMENTS 528 440 A1 2/1993 European Pat. Off. ..... 347/71
0584823 3/1994 European Pat. Off. .
0670218 9/1995 European Pat. Off. .
59-098859 6/1984 Japan .
4179549 11/1990 Japan .
6-40035 2/1994 Japan ..... B41J 2/045
6234218 8/1994 Japan ..... 347/71
9039242 2/1997 Japan .

*Primary Examiner*—Benjamin R. Fuller
*Assistant Examiner*—C. Dickens
*Attorney, Agent, or Firm*—Sughrue, Mion, Zinn, Macpeak & Seas, PLLC

[57] ABSTRACT

A recess is formed in a surface confronting an actuator unit of an ink supply inlet forming substrate. When a flow path unit and the actuator unit are bonded together using a fusible film, thermally expanded air is released into the recess to thereby reduce pressure. Further, by arranging the recess at a position confronting a pressure generating chamber, an air layer formed by the recess is allowed to function as a vibration shielding member.

14 Claims, 9 Drawing Sheets

LAMINATED INK JET RECORDING HEAD HAVING FLOW PATH UNIT WITH RECESS THAT CONFRONTS BUT DOES NOT COMMUNICATE WITH COMMON INK CHAMBER

BACKGROUND OF THE INVENTION

1. Field of the Invention

The invention relates to a laminated ink jet recording head formed by bonding an actuator unit made of ceramic and a flow path substrate formed of metal together.

2. Description of the Prior Art

For example, as shown in Japanese Patent Publication No. Hei. 6-40035, an ink jet recording head is designed so that piezoelectric vibrators are stuck to a part of a resilient plate forming a pressure generating chamber and the volume of each pressure generating chamber is changed by flexural displacement of the corresponding piezoelectric vibrator. Therefore, the ink jet recording head can displace a wide area of the pressure generating chamber. Therefore, such an ink jet recording head can produce ink droplets stably.

As shown in FIG. 15, such a recording head can be roughly divided into actuator units A, B, C and a single flow path unit D. The plurality of actuator units A, B, C are prepared by sintering a ceramic material into pressure generating chambers, vibration plates, and piezoelectric vibrators. The flow path unit D is made of a metal plate formed so as to correspond to a plurality of arrays of nozzle openings. The plurality of actuator units A, B, C and the flow path unit D are fixed to one another using an adhesive.

As described above, the plurality of actuator units are fixed to the flow path unit by means of a thermally fusing method in which a fusible film is interposed between the actuator units and the flow path unit and in which the fusible film is fused by heating with pressure being applied thereto.

However, since the bonding area is large, the air contained between the fusible film and the actuator units/the flow path unit expands and thereby causes defective bonding. Further, since the materials are heated for a long period of time, a difference in thermal expansion due to a difference in materials causes warp and the like.

In addition to these problems, with a progress in the downsizing of recording heads, the problem of so-called "crosstalk" occurs because vibrations of the piezoelectric vibrators propagate to the common ink chambers, and this in turn causes the meniscuses of the other pressure generating chambers through the ink in the common ink chamber. As a result, the problem of impaired printing quality, e.g., is encountered.

SUMMARY OF THE INVENTION

The invention has been made in view of the aforementioned problems. The object of the invention is therefore to provide a laminated ink jet recording head that can give a solution to the inconvenience attributable to thermal bonding between the flow path unit and the actuator unit as well as the problem of crosstalk and the like at once.

There is provided a laminated ink jet recording head comprising: an actuator unit having a piezoelectric vibrator on one surface thereof and a pressure generating chamber formed therein; and a flow path unit laminated on another surface of the actuator unit with a first surface thereof, the flow path unit having a common ink chamber formed therein; wherein a recess is formed on the first surface of the flow path unit in such a manner that the recess confronts said common ink chamber.

Since the recess of the flow path unit provides a space with respect to the actuator unit, the thermally expanded air is released into this recess to thereby reduce pressure. In addition, the air layer formed by the recess shields the propagation of vibrations from the piezoelectric vibration elements to the common ink chambers.

DETAILED DESCRIPTION OF THE PREFERRED EMBODIMENTS

Figure 1:
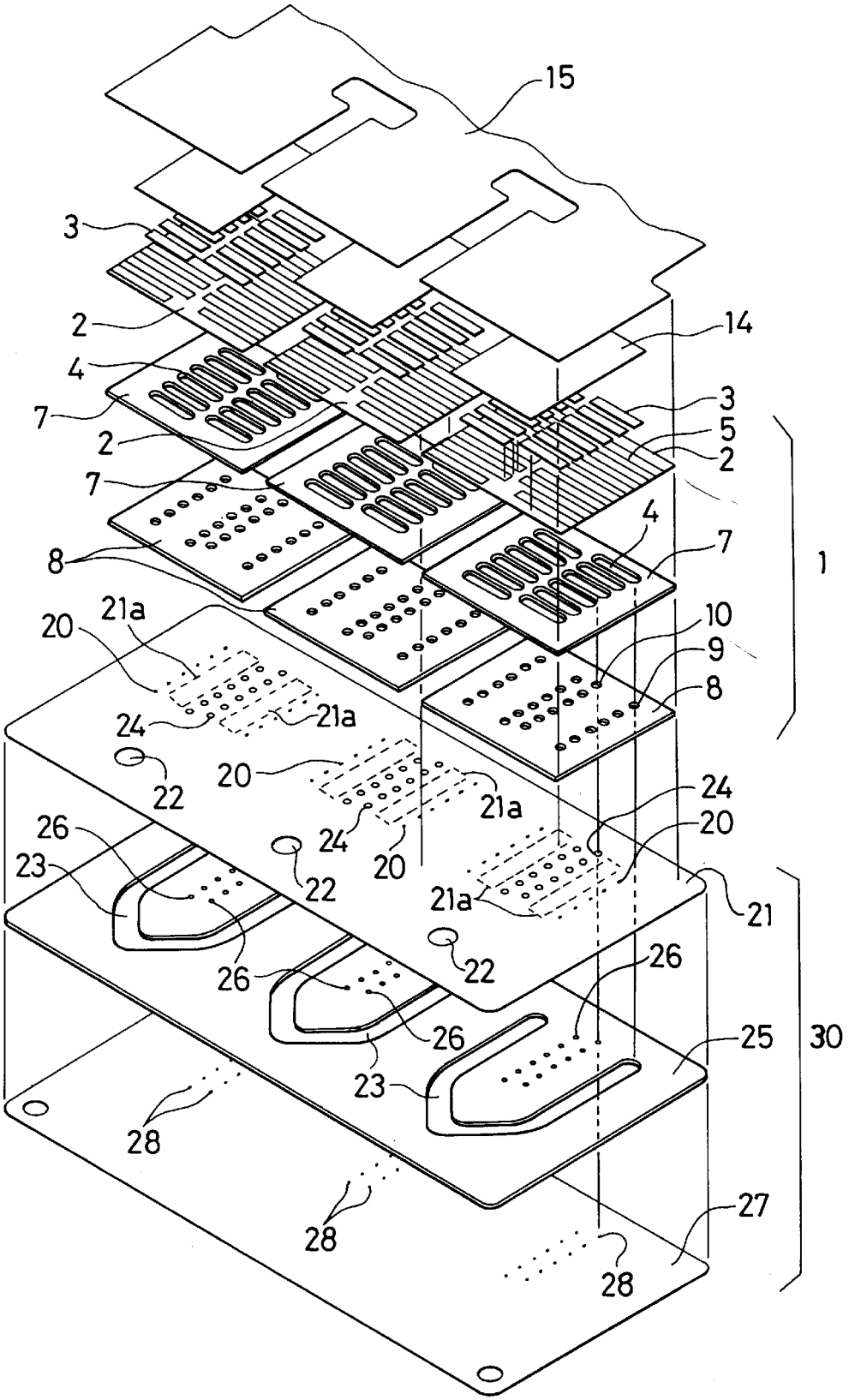
FIG. 1 is an exploded perspective view for assembling an ink jet recording head which is an embodiment of the invention.

Details of the invention will now be described with reference to the embodiments shown in the drawings.

Figure 2:
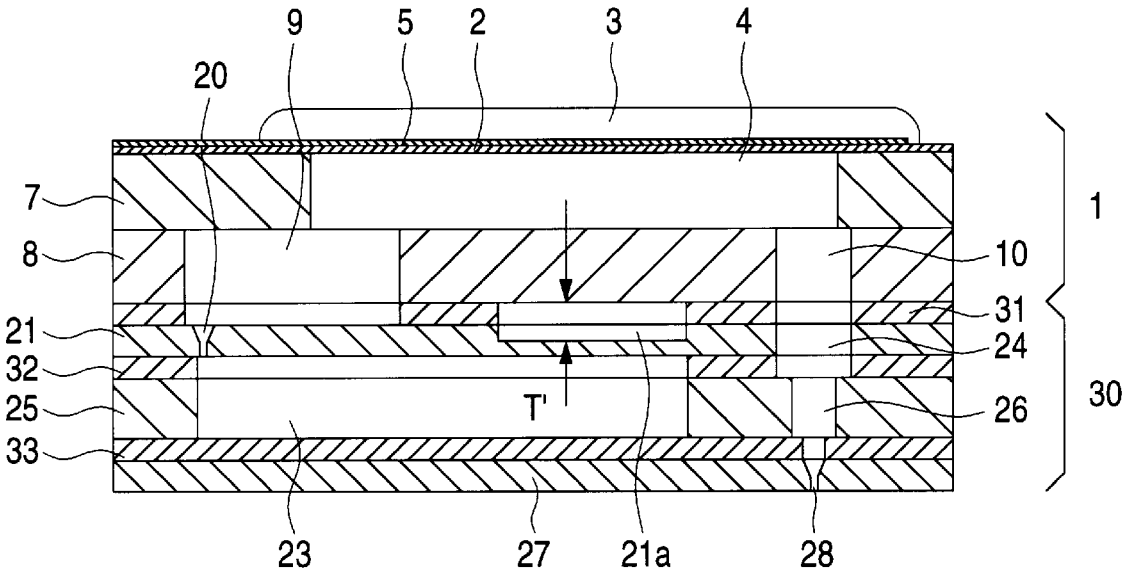
FIG. 2 is a sectional view of the ink jet recording head shown in FIG. 1.

FIG. 1 is an exploded perspective view for assembling showing the entire part of a recording head with fusible films omitted; and FIG. 2 is a sectional view showing a structure in the vicinity of a pressure generating chamber of a single actuator unit. In FIGS. 1 and 2, reference numeral 2 denotes a first cover body, that is constructed of a zirconia thin plate having a thickness of about 10 $\mu$m and has drive electrodes 5 formed on a surface thereof so as to confront pressure generating chambers 4 that will be described later. Piezoelectric vibrators 3 made of PZT or the like are fixed on the electrodes 5.

Each pressure generating chamber 4 contracts or expands in response to a flexural vibration of the corresponding piezoelectric vibrator 3 and thereby not only jets an ink droplet from a corresponding nozzle opening 28, but also sucks up ink from a common ink chamber 23 through an ink supply inlet 20.

Reference numeral 7 denotes a spacer, which is constructed by forming through holes in a ceramic plate made of zirconia ($ZrO_2$) having a thickness suitable for forming the pressure generating chambers 4, e.g., 150 $\mu$m. The spacer 7 has both surfaces thereof sealed by a second cover body 8 that will be described later and by the first cover body 2 to form the pressure generating chambers 4, respectively.

Reference numeral 8 denotes a second cover body, which is constructed by forming communication holes 9 and communication holes 10, which will be described later, in a ceramic plate made of zirconia or the like. Each communication hole 9 connects a corresponding ink supply inlet 20 and one end of a corresponding pressure generating chamber 4. Each communication hole 10 connects a corresponding nozzle opening 28 to the other end of the corresponding pressure generating chamber 4. The second cover body 8 is fixed to the other surface of the spacer 7.

These members 2, 7, 8 are assembled to an actuator unit 1 by molding a clay-like ceramic material into predetermined shapes and by laminating and sintering the shapes without using any adhesive.

Reference numeral 21 denotes an ink supply inlet forming substrate that serves also as an actuator unit 1 fixing substrate. A maximum rigidity is required for the ink supply inlet forming substrate 21 among the recording head forming members so that ink tank connecting members can also be arranged on the ink supply inlet forming substrate. As a result, metal such as a rust preventive steel or ceramic having ink repellency is selected as a material.

Figure 3:
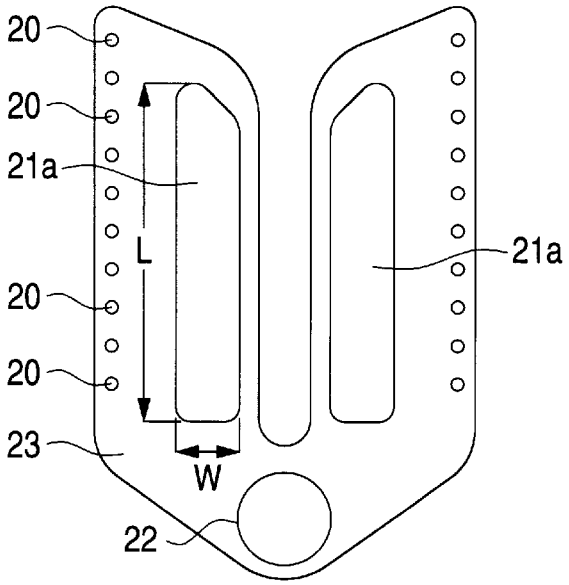
FIG. 3 is a diagram showing a positional relationship between recesses and a common ink chamber formed in an ink supply inlet forming substrate.

Recesses 21*a* are formed on a surface of the ink supply inlet forming substrate 21 confronting the common ink chambers 23. Each recess 21*a* opens onto a position confronting the pressure generating chamber 4 and onto an outer side, i.e., toward the actuator unit 1 as shown in FIGS. 2 and 3.

Figure 4:
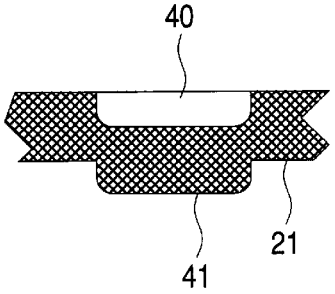
FIGS. 4(*a*) to 4(*c*) are diagrams showing a process for forming a recess in the ink supply inlet forming substrate.
Figure 4:
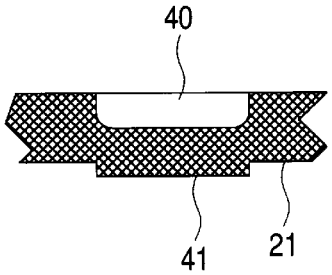
Figure 4:
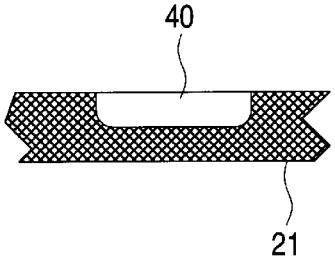

Such a recess 21*a* is finished into a flat surface (FIG. 4(*c*)) by forming a recess 40 in a surface confronting the common ink chamber 23 of the ink supply inlet forming substrate 21 (FIG. 4(*a*)) and grinding a projection 41 on the other surface (FIG. 4(*b*)) when a metal is used to form the ink supply inlet forming substrate 21.

Figure 5:
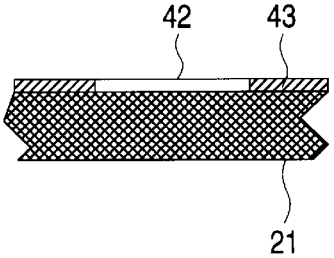
FIGS. 5(*a*) to 5(*c*) are diagrams showing another exemplary process for forming a recess in the ink supply inlet forming substrate.
Figure 5:
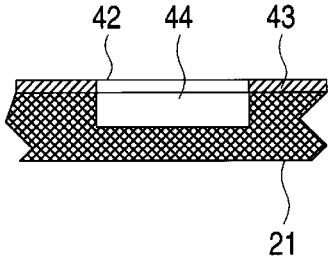
Figure 5:
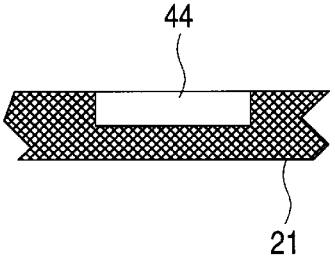

Another technique may be also applicable. The technique involves the steps of: forming an etching protective coat 43 having a window 42 in a surface of the ink supply inlet forming substrate 21 confronting the common ink chamber (FIG. 5(*a*)); forming a recess 44 by etching only a single surface (FIG. 5(*b*)); and removing the etching protective coat 43 thereafter (FIG. 5(*c*)).

Figure 6:
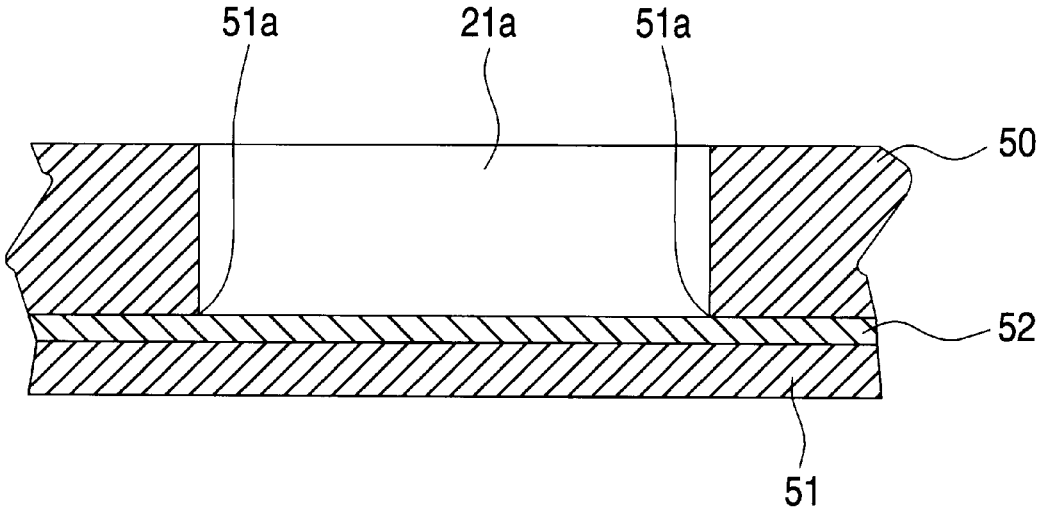
FIG. 6 is a sectional view showing another exemplary ink supply inlet forming substrate.

Still another technique is also applicable. As shown in FIG. 6, this technique involves the steps of: preparing a plate member formed by laminating and bonding two rust preventive metal thin plates 50, 51 through an adhesive film 52; and selectively removing a portion corresponding to the recess 21*a* of one 50 of the metal thin plates by etching with the adhesive film 52 as an etching stopper. There still is another technique, which is characterized as forming a thick-walled portion by electroforming while masking a portion corresponding to the recess 21*a* on a surface of the substrate.

Figure 7:
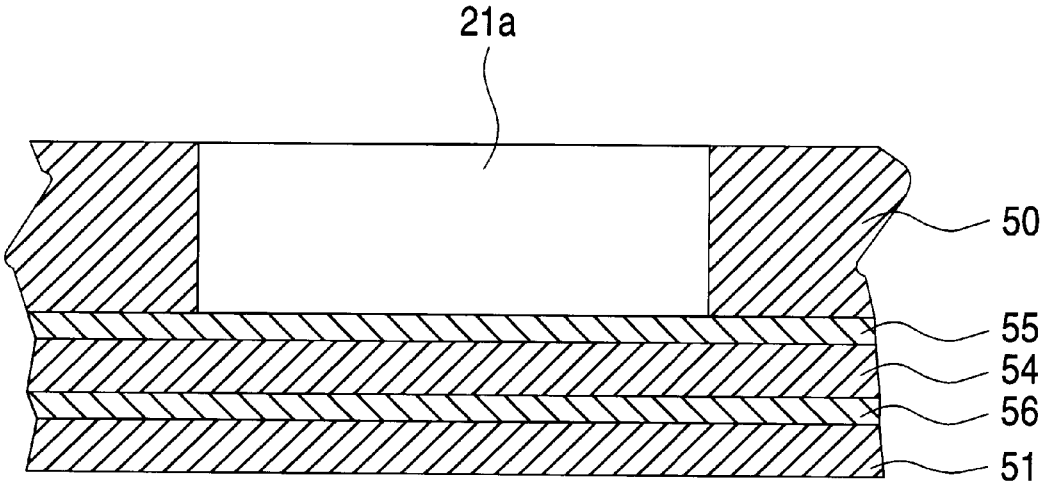
FIG. 7 is a sectional view showing another exemplary ink supply inlet forming substrate.

As shown in FIG. 7, there still is another technique, which involves the steps of: laminating and bonding two metal thin plates 50, 51 while interposing a plastic film, such as a PPS or PI film 54, between the two metal thin plates 50, 51 through adhesive films 55, 56; and selectively removing a portion corresponding to the recess 21*a* of one 50 of the metal thin plates by etching with the film 54 as an etching stopper.

As shown in FIGS. 1 and 2, the ink supply inlet forming substrate 21 has the ink supply inlets 20 formed on one side of the pressure generating chambers 4 and communication holes 24 on the other side of the pressure generating chambers 4. Each ink supply inlet 20 connects the common ink chamber 23 to be described later to the corresponding pressure generating chamber 4. Each communication hole 24 connects the pressure generating chamber 4 to the corresponding nozzle opening 28.

Further, ink introducing ports 22, 22, 22 are formed at positions off an actuator unit 1 fixing region. The ink introducing ports allow the ink to flow in from a not shown ink tank.

Reference numeral 25 denotes a common ink chamber forming substrate that is constructed by forming through holes and communication holes 26. The common ink chamber forming substrate 25 is constructed of a plate member having a thickness suitable for forming the common ink chambers 23, i.e., a corrosion resistant plate member such as a 150 $\mu$m-thick stainless steel. The through holes correspond to the shapes of the common ink chambers 23. Each communication hole 26 connects to a corresponding nozzle opening 28 formed in a nozzle plate 27.

The ink supply inlet forming substrate 21, the common ink chamber forming substrate 25, and the nozzle plate 27 are assembled to a flow path unit 30 while fixed with adhesive layers 32, 33 such as fusible films or adhesives interposed therebetween.

Figure 8:
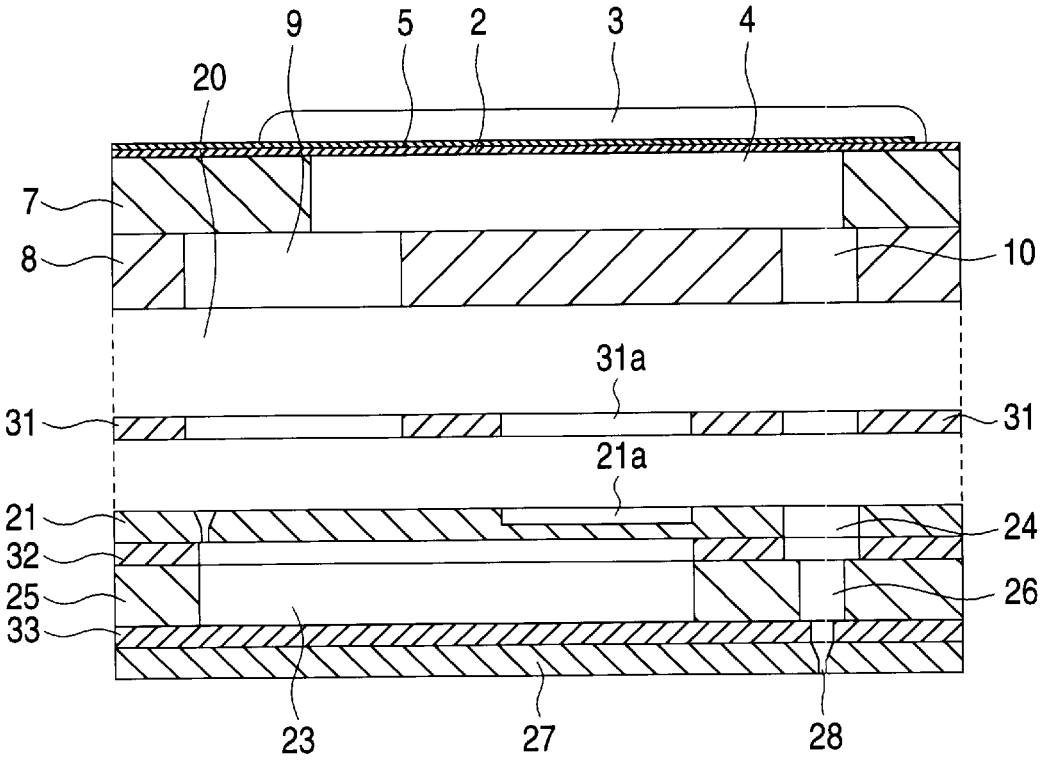
FIG. 8 is a diagram showing a process for bonding the actuator unit to a flow path unit.

When the fusible film 31 and the actuator unit 1 are sequentially laminated one upon another on a surface of the ink supply inlet forming substrate 21 of the flow path unit 30 as shown in FIG. 8 and thereafter heated while pressed, the flexible film 31 rapidly softens and fuses as the temperature of the bonding region increases rapidly.

Although the heating causes the air confined between the fusible film 31 and the actuator unit 1/the flow path unit 30 to expand, an increase in pressure is reduced by a space formed by the recess 21*a* of the ink supply inlet forming substrate 21 and a window 31*a* of the fusible film 31. Therefore, the bonding surface can be bonded reliably.

For example, when a recess 21*a* having a length L of 8.73 mm, a width W of 1.74 mm, and a thin walled portion thickness ranging from 15 to 25 $\mu$m is formed in the ink supply inlet forming substrate 21, the recess 21*a* exhibits a resiliency of about $1\times10^{-15}$ $m^3$/Pa. Therefore, the increase in pressure caused by thermally expanded air at the time of bonding can be sufficiently absorbed.

Further, a thickness T' (FIG. 2) of an air layer formed between the recess 21*a* and the adhesive layer functions as an appropriate vibration shielding member with respect to vibrations propagated from the actuator unit 1. This construction contributes to preventing the ink from being supplied to the pressure generating chambers 4 defectively. That is, vibrations caused at the pressure generating chambers 4 at the time of jetting ink droplets are propagated to the common ink chamber 23, and this propagation to the common ink chamber 23 induces vibrations to the ink in the common ink chamber, which in turn affects the supply of the ink to the pressure generating chambers.

It may be noted that reference numeral 14 in FIGS. 1 and 2 denotes a common electrode formed on the surface of the piezoelectric vibrator 3 and that reference numeral 15 denotes a flexible cable that connects the actuator unit to an external device.

When a drive signal is applied to a piezoelectric vibrator 3 in this embodiment, the piezoelectric vibrator 3 vibrates in flexure to contract the corresponding pressure generating chamber 4. As a result, pressure is applied to the ink within the pressure generating chamber 4 to thereby drive an ink droplet out of the corresponding nozzle opening 28.

At this moment, vibrations of the piezoelectric vibrator 3 transmitted through the actuator unit 1 reach the common ink chamber 23 after having being damped by reflection and absorption due to an extremely large difference in impedance caused by the air layer in the recess 21*a* of the ink supply inlet forming substrate 21. Therefore, transmission of vibrations inducing pressure fluctuations in other pressure generating chambers 4 through the common ink chamber 23, which has heretofore been a problem, can be reduced significantly.

Further, since the bonding area between the ink supply inlet forming substrate 21 and the actuator unit 1 can be limited easily, the durability of the adhesive with respect to a heat cycle can be improved by absorbing a difference in thermal expansion caused by a difference in the materials of which both members are made.

By the way, as shown in FIG. 6, if plate members formed by laminating and bonding two metal thin plates 50, 51 through the adhesive film 52 are prepared and the portion corresponding to the recess 21*a* of the metal thin plate 50 is selectively removed by etching with the adhesive film 52 as an etching stopper, the boundary 51*a* of the recess 21*a* is exposed and it is therefore likely that the adhesive strength of the boundary 51*a* is slightly reduced because the etching solution affects this region.

When the actuator unit 1 is heated and bonded while receiving pressure with the fusible film 31 placed on the surface of the metal thin plate 50 under this condition, stresses concentrate on this boundary to cause separation. There also is the possibility that the air contained between the fusible film 31 and the actuator unit 1/the flow path unit 30 will thermally expand and enter into the depth from the boundary 51*a* to thereby cause large separation.

Figure 9:
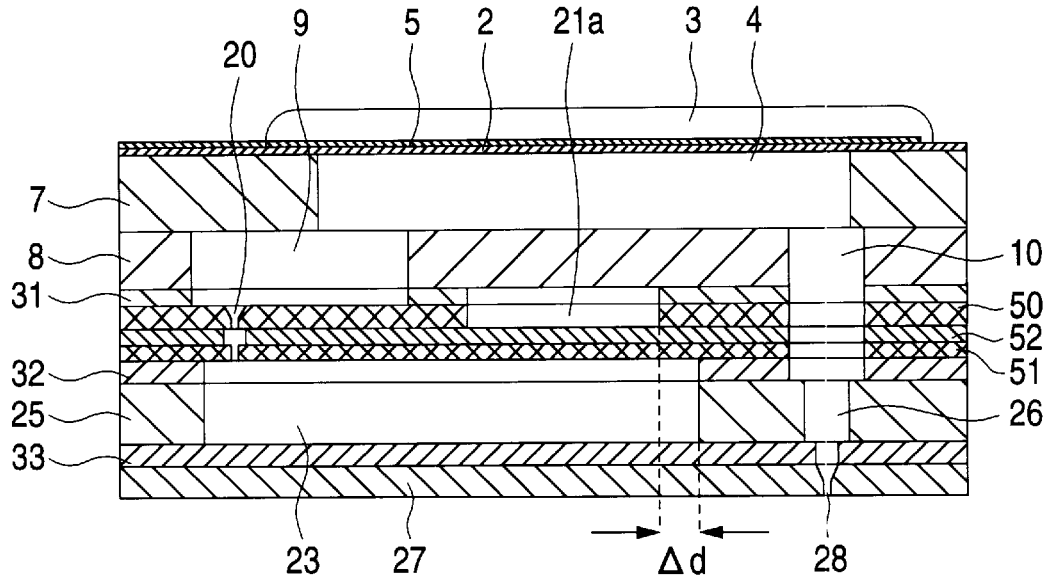
FIG. 9 is a sectional view showing an embodiment of the invention using an ink supply inlet forming substrate formed by bonding two thin plates together.
Figure 10:
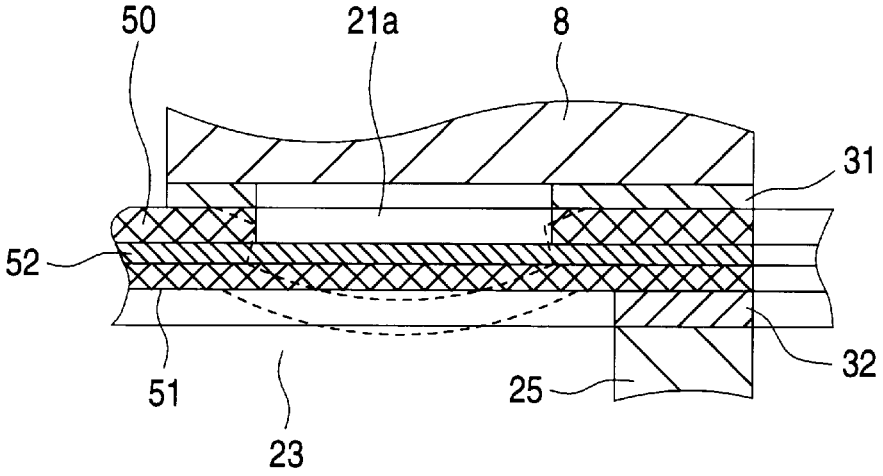
FIG. 10 is a diagram showing the vicinity of a recess in enlarged form.

FIG. 9 shows an embodiment that is applicable to a case where the recess 21*a* is formed by etching one surface with two such metal thin plates 50, 51 bonded through the adhesive film 52. The position of the recess 21*a* is displaced by a predetermined distance Δd inside the common ink chamber 23 from the edge of the chamber 23, so that the recess 21*a* is easy to flex at this region.

According to this embodiment, the metal thin plates 50, 51 and the layer formed of the fusible film 52 are resiliently deformed integrally even if stresses are applied to part of the recess 21*a* with pressure being applied during the fusing operation. Therefore, promotion of the separation of the thin plate 50 due to expansion of the air can be controlled by preventing intensive stress concentration at the boundary 51*a*.

Figure 11:
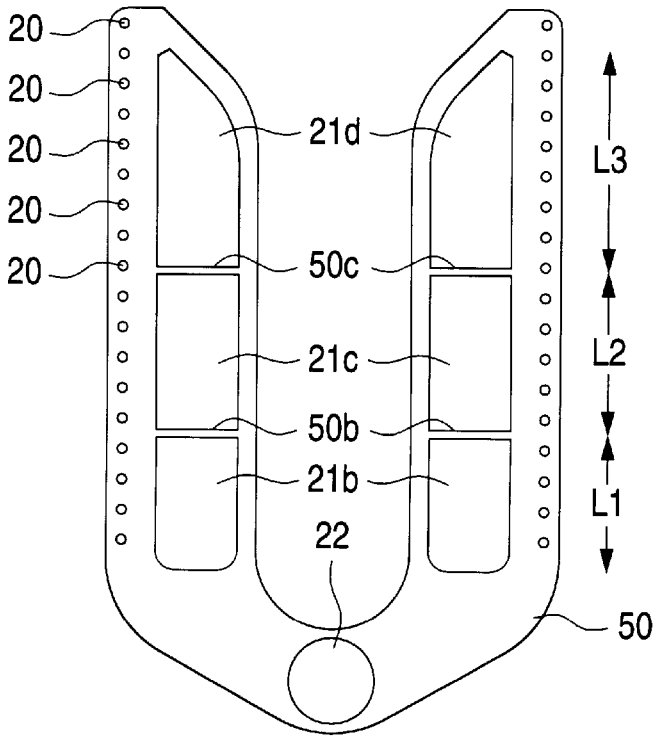
FIG. 11 is a plan view showing another embodiment of the invention using an ink supply inlet forming substrate formed by bonding two thin plates together.

FIG. 11 shows another embodiment that is applied to avoid the problem caused when two metal thin plates 50, 51 are bonded through the adhesive film 52. In this embodiment, a plurality of recesses 21*b*, 21*c*, 21*d* are formed by etching the metal thin plate 50 to be etched in such a manner that ribs 50*b*, 50*c* extending in the width direction are left arranged at a predetermined interval in the nozzle opening arrangement direction. More preferably, intervals L1, L2, L3 at which the ribs 50*b*, 50*c* are positioned are increased (L1<L2<L3) with increasing distance from the ink introducing port 22.

The metal thin plate 50 and the adhesive film 52 are relatively susceptible to be separated from each other along the boundaries of the recesses 21*b*, 21*c*, 21*d* in the longitudinal direction due to receiving stresses. However, the boundaries in the longitudinal direction are designed so as to mutually be pulled toward each other by the ribs 50*b*, 50*c*. Therefore, the floating of the metal thin plate 50 from the adhesive film 52 can be prevented. Further, the intervals L1, L2, L3 at which the ribs 50*b*, 50*c* are arranged are increased as the ribs 50*b*, 50*c* get away from the ink introducing port 22, and the area of the recess 21*d* that is the remotest from the ink introducing port 22 is increased. Therefore, separation can be prevented without controlling compliance in the depth of the common ink chamber uselessly.

Figure 12:
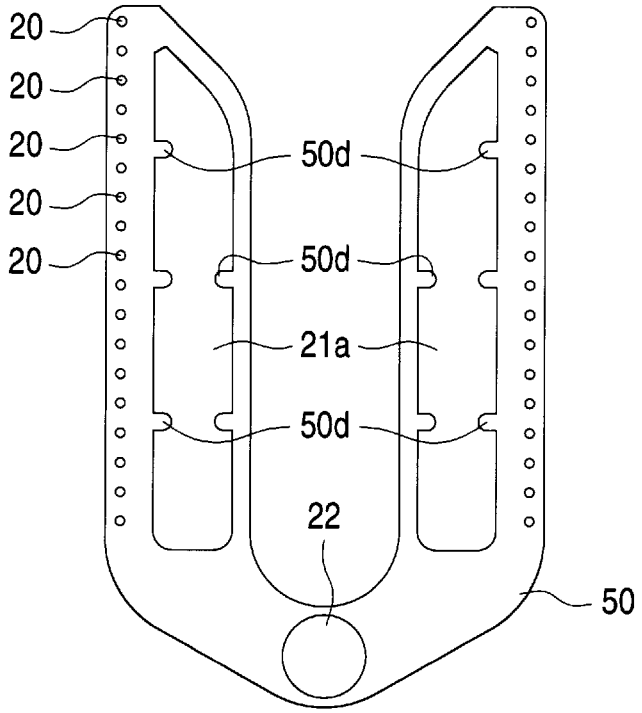
FIG. 12 is a plan view showing another embodiment of the invention using an ink supply inlet forming substrate formed by bonding two thin plates together.

FIG. 12 shows another embodiment that is designed to prevent the separation. In this embodiment, projections 50*d*, 50*d* . . . are arranged at a predetermined interval along the boundaries of the metal thin plate 50 in th e longitudinal direction confronting the recesses 21*a*, the metal thin plate 50 forming th e recesses 21*a*.

According to this embodiment, the bonding area at the boundaries can be increased by the projections 50*d*, 50*d* . . . , which in turn prevents separation.

Figure 13:
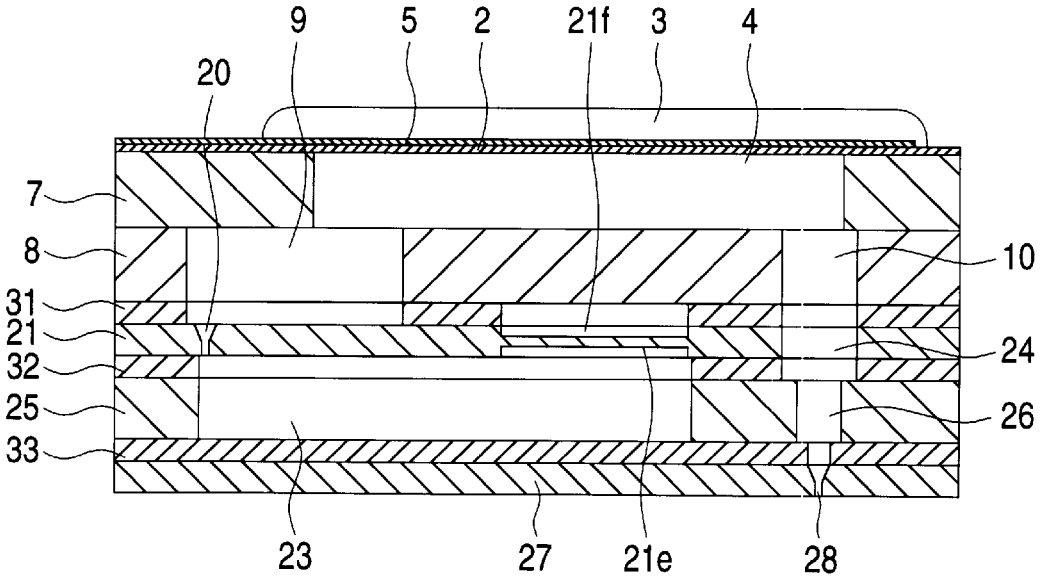
FIG. 13 is a sectional view showing an ink jet recording head, which is another embodiment of the invention, in the form of a structure in the vicinity of a pressure generating chamber of a single actuator unit.

It may be noted that shallow recesses 21*e*, 21*f* can be formed so as to confront each other from both surfaces of the ink supply inlet forming substrate 21 as shown in FIG. 13 if it is difficult to machine a deep recess 21*a* in the ink supply inlet forming substrate 21 with high accuracy.

This embodiment can also absorb pressure increase caused by thermal expansion at the time of the fusing operation using one 2*e* of the recesses. In addition, not only propagation of vibrations from the actuator unit 1 to the common ink chamber can be prevented together with the other recess 21*f*, but also the bonding area of the actuator unit 1 is reduced as much as possible to thereby allow the thermal expansion differences to be absorbed.

Figure 14:
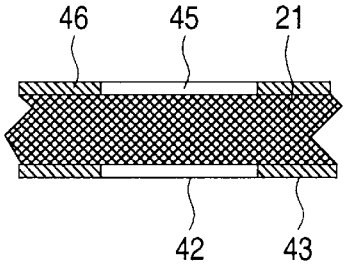
FIGS. 14(*a*) to 14(*c*) are diagrams showing an exemplary process for fabricating an ink supply inlet forming substrate of the recording head shown in FIG. 13.
Figure 14:
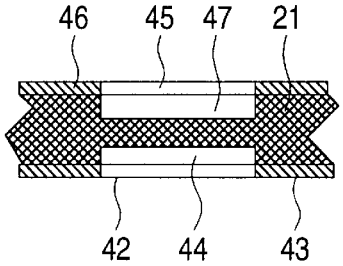
Figure 14:
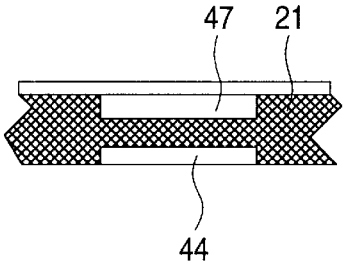
Figure 15:
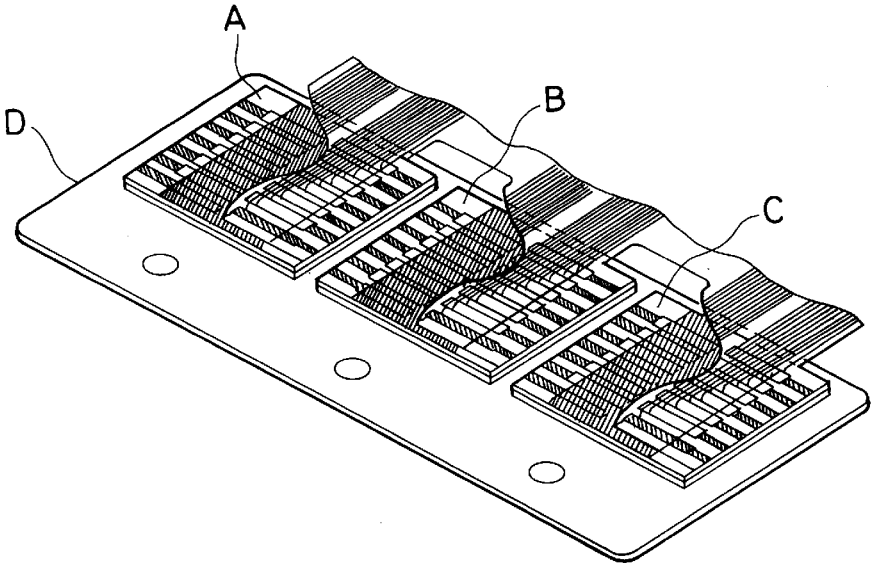
FIG. 15 PRIOR ART
FIG. 15 is a perspective view showing an ink jet recording head having a plurality of actuator units on a flow path unit.

As shown in FIGS. 14(*a*) to 14(*c*) , such ink supply inlet forming substrate can be formed by arranging etching protective coats 43, 46 having windows 42, 45 at positions confronting the recesses 21*e*, 21*f* of the ink supply inlet forming substrate 21 on both surfaces thereof (FIG. 14(*a*)), forming the recesses 21*e*, 21*f* by etching both surfaces thereafter (FIG. 14(*b*)), and removing the etching protective coats 43, 46 (FIG. 14(*c*)).

The arrangement of the recesses 21*e*, 21*f* on both surfaces is helpful not only in shortening the machining time as well as ensuring accuracy because the etching depth is small.

Figure 16:
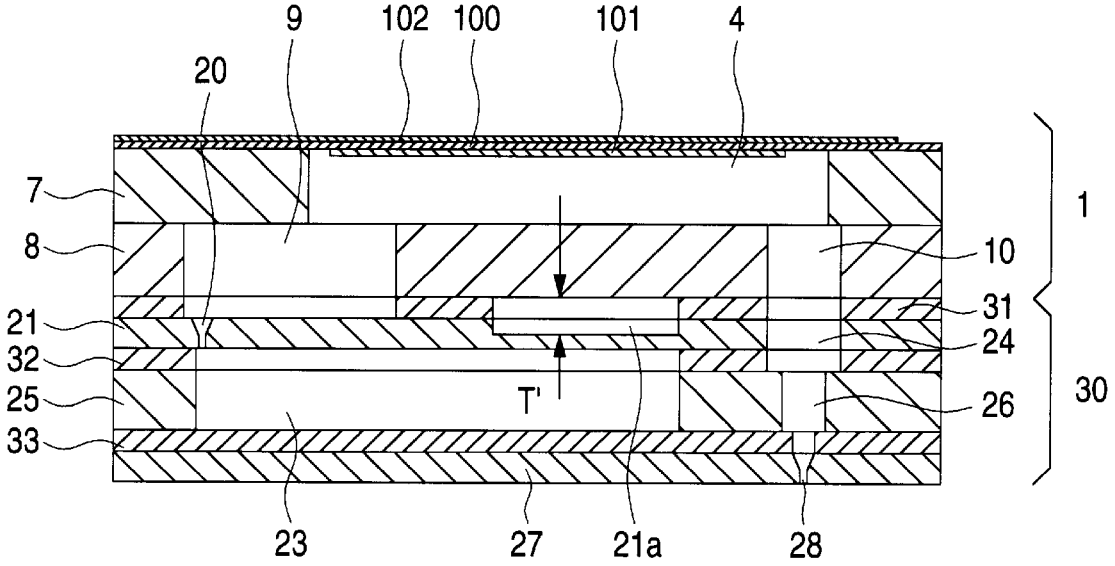
FIG. 16 is a sectional view showing an ink jet recording head, which is another embodiment of the invention, in the form of a structure in the vicinity of a pressure generating chamber of a single actuator unit.
Figure 17:
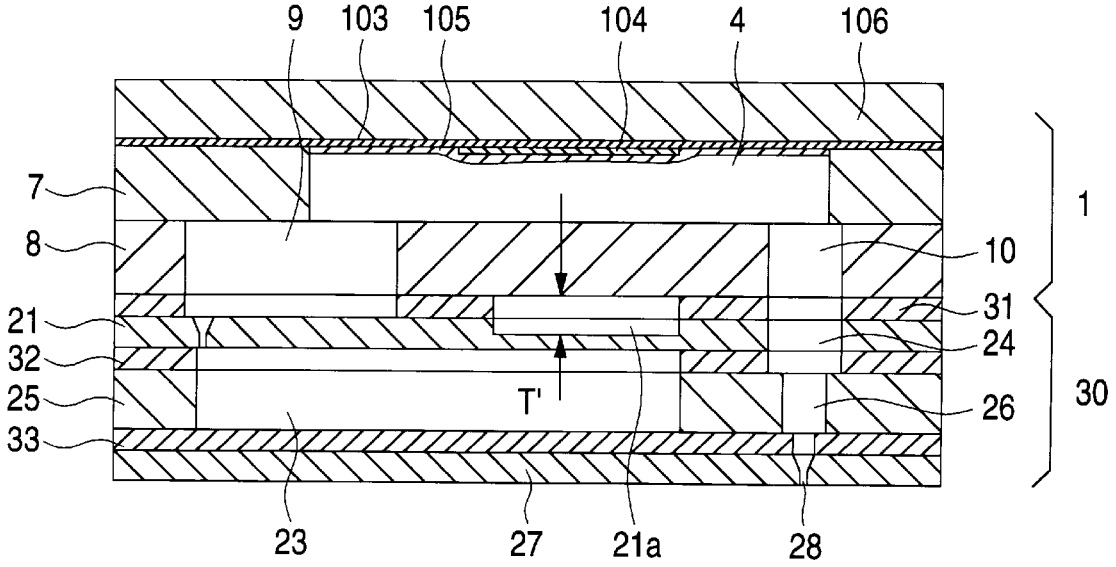
FIG. 17 is a sectional view showing an ink jet recording head, which is still another embodiment of the invention, in the form of a structure in the vicinity of a pressure generating chamber of a single actuator unit.

In the aforementioned actuator unit, the pressure generating means comprises the first cover body 2, the piezoelectric vibrators 3 and the drive electrodes 5 as shown in FIGS. 1 and 2. Alternatively, the pressure generating means which comprises piezoelectric vibrating plates 100, lower electrodes 101 and upper electrodes 102 so as to seal a surface of the spacer 7 may be applied as shown in FIG. 16. Furthermore, the pressure generating means comprising cover plates 106, electrically conductive layer 103, heating elements 104 and protective layer 105 may be used as shown in FIG. 17. Other constitutions which make the pressure in the pressure generating chamber change may be used for the present invention.

As described in the foregoing, the invention is characterized as reducing pressure by allowing the recess to release the thermally expanded air during bonding into a surface of the ink supply inlet forming substrate confronting the actuator unit, and the bonding area is reduced to a minimum to allow thermal expansion differences between both members to be absorbed by the adhesive layer. Further, since the recess is formed in a region confronting the pressure generating chamber, the air layer formed by the recess functions as a vibration shielding member, which in turn contributes to preventing the propagation of vibrations from the piezoelectric vibrators to the common ink chamber.

What is claimed is:

1. A laminated ink jet recording head comprising:

an actuator unit hating a pressure generating chamber and means for generating pressure in said chamber; and a flow path unit having a surface to which said actuator is laminated, said flow path unit having a common ink chamber formed therein, wherein said flow path unit further comprises a recess that is formed in said surface and confronts said common ink chamber and said pressure generating chamber, said recess being disposed between said common ink chamber and said pressure generating chamber without being in fluid communication with said common ink chamber and said pressure generating chamber.

2. The laminated ink jet recording head according to claim 1, wherein said actuator unit comprises:

a first cover body in which said means for generating pressure is formed; and a spacer having a surface which is sealed by said first cover body to at least partially define said pressure generating chamber.

3. The laminated ink jet recording head according to claim 2, wherein said spacer has another surface, and wherein said actuator unit further comprises:

a second cover body sealing said another surface of said spacer, said second cover body having a communication hole which communicates with said common ink chamber.

4. The laminated ink jet recording head according to claim 1, wherein said flow path unit comprises:

an ink supply inlet forming substrate having one surface in which said recess is formed;

a common ink chamber forming substrate laminated on said ink supply inlet forming substrate and having said common ink chamber formed therein; and a nozzle plate laminated on said common ink chamber forming substrate and having a nozzle opening.

5. The laminated ink jet recording head according to claim 4, wherein said ink supply inlet forming substrate comprises:

two metal thin plates bonded together by an adhesive layer, wherein said recess is a partially removed portion of one of said metal thin plates.

6. The laminated ink jet recording head according to claim 1, wherein a circumferential edge of said recess is displaced inside said common ink chamber from an edge of said common ink chamber.

7. The laminated ink jet recording head according to claim 1, wherein said recess is split into a plurality of regions.

8. The laminated ink jet recording head according to claim 7, further comprising an ink flowing port into which ink is introduced, wherein an area of each one of said regions increases with increasing distance from said ink flowing port.

9. The laminated ink jet recording head according to claim 1, further comprising a plurality of projections on a circumferential edge of said recess, said projections projecting inside said recess.

10. The laminated ink jet recording head according to claim 4, wherein said ink supply inlet forming substrate has another surface opposite said one surface, and wherein another recess is formed in said another surface opposite said recess.

11. The laminated ink jet recording head according to claim 4, wherein said ink supply inlet forming substrate comprises:

two metal thin plates bonded together by an adhesive layer, wherein said recess is formed by partially removing one of said metal thin plates with the adhesive layer as an etching stopper.

12. The laminated ink jet recording head according to claim 4, wherein said ink supply inlet forming substrate comprises:

a first metal thin plate, a first adhesive layer, a plastic film, a second adhesive layer and a second metal thin plate in that order, wherein said recess is formed by partially removing one of said first metal thin plate and said second metal thin plate with said plastic film as an etching stopper.

13. The laminated ink jet recording head according to claim 1, further comprising a fusible film for bonding said actuator unit to said flow path unit, wherein said fusible film comprises a window confronting said recess.

14. A laminated ink jet recording head comprising:

an actuator unit having a pressure generating chamber and means for generating pressure in said chamber; and a flow path unit having a surface to which said actuator unit is laminated, said flow path unit having a common ink chamber formed therein, wherein said flow path unit further comprises:

an ink supply inlet forming substrate having a recess that confronts said common ink chamber;

a common ink chamber forming substrate laminated on said ink supply inlet forming substrate and having said common ink chamber formed therein; and a nozzle plate laminated on said common ink chamber forming substrate and having a nozzle opening, wherein said ink supply inlet forming substrate comprises:

a first metal thin plate, a first adhesive layer, a plastic film, a second adhesive layer and a second metal thin plate in that order, wherein said recess is formed by partially removing one of said first metal thin plate and said second metal thin plate with said plastic film as an etching stopper.

* * * * *